US010871339B2

(12) United States Patent
Elftmann, Jr.

(10) Patent No.: US 10,871,339 B2
(45) Date of Patent: Dec. 22, 2020

(54) CAPTIVE DISCONNECTOR

(71) Applicant: Arthur J Elftmann, Jr., Glendale, AZ (US)

(72) Inventor: Arthur J Elftmann, Jr., Glendale, AZ (US)

( * ) Notice: Subject to any disclaimer, the term of this patent is extended or adjusted under 35 U.S.C. 154(b) by 82 days.

(21) Appl. No.: 16/212,469

(22) Filed: Dec. 6, 2018

(65) Prior Publication Data

US 2020/0182573 A1 Jun. 11, 2020

(51) Int. Cl.

| | |
|---|---|
| ***F41A 19/10*** | (2006.01) |
| ***F41A 19/52*** | (2006.01) |
| ***F41A 19/16*** | (2006.01) |
| ***F41A 19/14*** | (2006.01) |

(52) U.S. Cl.

CPC ..... *F41A 19/10* (2013.01); *F41A 19/14* (2013.01); *F41A 19/16* (2013.01); *F41A 19/52* (2013.01)

(58) Field of Classification Search

CPC ..... F41A 19/10; F41A 19/14; F41A 19/16; F41A 19/52; F41A 19/06

USPC ..... 42/69.01, 69.02, 69.03; 89/136

See application file for complete search history.

(56) References Cited

U.S. PATENT DOCUMENTS 1,930,864 A * 10/1933 Schmeisser ..... F41A 17/52 89/148
5,881,485 A * 3/1999 Milazzo ..... F41A 19/16 42/69.03
6,131,324 A * 10/2000 Jewell ..... F41A 19/16 42/69.03
6,772,548 B1 * 8/2004 Power ..... F41A 19/10 42/69.03
7,421,937 B1 * 9/2008 Gangl ..... F41A 17/46 42/69.03
7,600,338 B2 * 10/2009 Geissele ..... F41A 19/10 42/69.03
9,310,150 B1 * 4/2016 Geissele ..... F41A 19/16
9,541,342 B1 * 1/2017 Blake ..... F41A 19/16
(Continued)

*Primary Examiner* — Joshua E Freeman
(74) *Attorney, Agent, or Firm* — Douglas W. Rudy

(57) ABSTRACT

Provided is a trigger assembly that helps prevent malfunctioning of trigger assemblies in firearms. This is accomplished by the expedient of a convex curved projection on the upper surface of the actual trigger of the trigger assembly. Interfacing with this convex surface on the trigger is a mating concave curved projection having a surface with a radius that is similar to the radius of the trigger's concave curved projection. The trigger's concave curved projection extends relatively downwardly from the bottom side of the actual hammer of the trigger assembly. The relationship of the trigger and the hammer of the trigger assembly provides a trigger/hammer interface when the convex curved projection of the trigger is proximate the concave curved projection of the hammer. In this trigger assembly there is a captive disconnector having a disconnector engagement stabilizing projection formed as a portion of the disconnector. The stabilizing projection is generally opposite from the portion of the disconnector having a hook or small ledge where there is contact between the projecting elements of the disconnector and of the hammer. This disconnector engagement stabilizing projection limits the travel of the disconnector interfacing projection of the hammer from moving away from the disconnector engagement location of the trigger assembly.

1 Claim, 2 Drawing Sheets

(56) References Cited

U.S. PATENT DOCUMENTS

| | | | | |
|---|---|---|---|---|
| 9,927,197 | B1 * | 3/2018 | Geissele | F41A 19/10 |
| 2006/0086031 | A1 * | 4/2006 | Geissele | F41A 19/16<br>42/69.03 |
| 2011/0079137 | A1 * | 4/2011 | Audibert | F41A 19/14<br>89/136 |
| 2014/0259845 | A1 * | 9/2014 | Johnson | F41A 19/10<br>42/69.01 |
| 2015/0233662 | A1 * | 8/2015 | Ruiz | F41A 19/12<br>42/69.03 |
| 2015/0253095 | A1 * | 9/2015 | Wilson | F41A 19/12<br>42/69.01 |
| 2016/0018176 | A1 * | 1/2016 | Fellows | F41A 19/14<br>42/69.03 |
| 2016/0131448 | A1 * | 5/2016 | Bender | F41A 19/33<br>42/69.01 |
| 2016/0153732 | A1 * | 6/2016 | Geissele | F41A 19/10<br>42/69.01 |
| 2016/0178304 | A1 * | 6/2016 | Geissele | F41A 19/14<br>42/69.01 |
| 2016/0363401 | A1 * | 12/2016 | Elftmann | F41A 19/15 |
| 2017/0122686 | A1 * | 5/2017 | Fellows | F41A 17/74 |
| 2018/0045481 | A1 * | 2/2018 | Williams | F41A 17/48 |
| 2018/0202740 | A1 * | 7/2018 | Elftmann, Jr. | F41A 19/15 |
| 2018/0224232 | A1 * | 8/2018 | Gillette | F41A 19/10 |
| 2019/0353443 | A1 * | 11/2019 | Gillette | F41A 19/14 |
| 2019/0368835 | A1 * | 12/2019 | Schacht | F41A 19/10 |
| 2020/0096278 | A1 * | 3/2020 | Olson | F41A 19/44 |

* cited by examiner

CAPTIVE DISCONNECTOR

BACKGROUND OF THE INVENTION

Field of the Invention

This invention is a trigger assembly that prevents the forward report of the trigger. To accomplish this a convex curved projection one the upper surface of the actual trigger of the trigger assembly. A mating concave curved projection extends relatively downwardly from the bottom side of the actual hammer of the trigger assembly. This provides a trigger/hammer interface when the convex curved projection of the trigger is proximate the concave curved projection of the hammer.

A second element of the trigger assembly, the captive disconnector, disclosed here comprises a disconnector engagement stabilizing projection which is formed as a portion of the disconnector generally opposite from the portion of the disconnector having a hook or small ledge where there is contact between the projecting elements of the disconnector and of the hammer. This disconnector engagement stabilizing projection limits the travel of the disconnector interfacing projection of the hammer from moving away from the disconnector engagement location of the trigger assembly.

Description of Known Art

The trigger presented in this invention is a modular trigger that is used primarily in rifles and most usually in automatic and semi-automatic rifles. A version of a trigger similar to the trigger presented herein, but lacking the captive disconnector and the convex curved projection of the trigger and the interfacing concave curved projection of the hammer, presented in this trigger assembly, is shown in U.S. patent application Ser. No. 14/492,065, herein incorporated by reference.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides a device that prevents the forward report of a trigger of a trigger assembly.

It also provides a disconnector engagement stabilizing projection that limits the travel of a disconnector interfacing projection of the trigger assembly's hammer from moving away from the disconnector engagement location of the trigger assembly.

An advantage of this invention is that this device is an easy replacement of a trigger that doesn't have the captive disconnector feature presented here.

It is also an advantage to this invention in that it can be installed at the manufacturing facility of a weapon manufacturer without the need for retooling of the lower receiver. Thus there are no added machining costs for manufacturers to incorporate the adjustable pull trigger in their lower receivers.

Another advantage is that a person or persons assembling a rifle from component parts can fit this device in the lower receiver that she or he is using for the assembly without a need to have a special lower receiver or special machining to accommodate this adjustable trigger.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the drawing figures wherein.

Elements and acts depicted in the figure are illustrated for simplicity. They are presented to illustrate the invention to assist in an understanding thereof. The figure is not necessarily been rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

As mentioned above, this invention has to do with rifles and particularly the removable trigger assembly carried in the lower receiver of a rifle. This modified trigger assembly may replace similar trigger assemblies that don't have the disconnector feature and/or the hammer travel-limiting feature included in the trigger as this trigger does.

Figure 1:
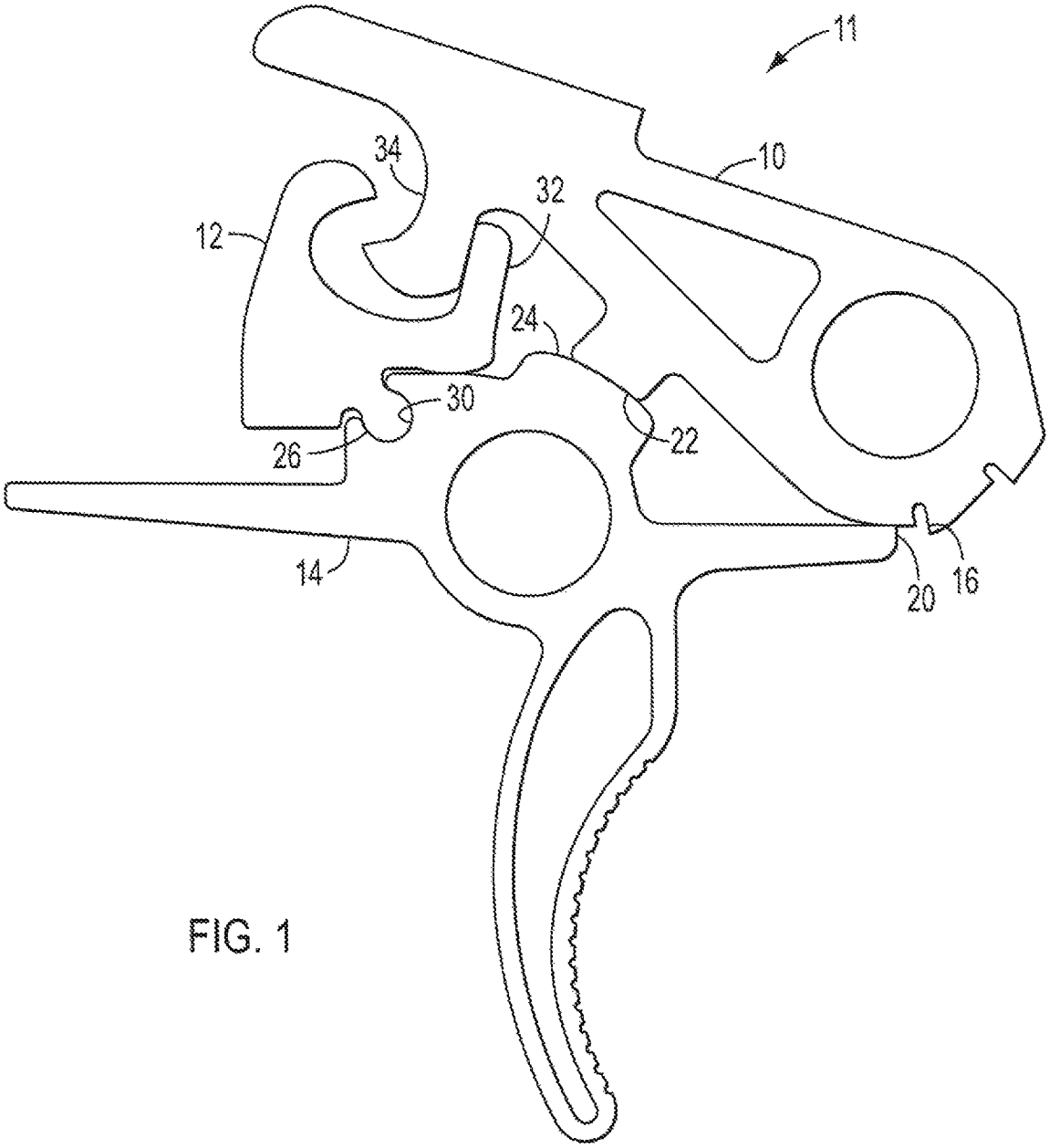
FIG. 1 shows an elevation view of the trigger assembly having a captive disconnector; the convex curved projection on the upper surface of the actual trigger of the trigger assembly; and mating concave curved projection extending relatively downwardly from the bottom side of the actual hammer of the trigger assembly.

FIG. 1 is a depiction of a trigger assembly, generally 11, with various springs, bearings and adjustment elements left out of the depiction for clarity. The hammer 10 is shown proximate the disconnector 12 and the trigger 14. The hammer 10 and the trigger 14 are pivotably mounted in a housing (not shown). The hammer 10 will rotate in a direction away from the pull direction of the trigger 14 such that the sear 16, shown angularly positioned before the sear engagement end 20 of the trigger 14 restrains the hammer 10 from rotating clockwise, through spring pressure (spring not shown), in FIG. 1 until the trigger 14 is pulled to fire the host weapon. When the hammer 10 is in a ready to fire position with the sear engagement end 20 interfacing with the sear 16 the trigger holding the trigger assembly in a fixed, but ready to fire position.

FIG. 1 shows the hammer 10 having concave curved projection 22 extending relatively downwardly from the bottom side of the actual hammer 10 of the trigger assembly. A convex curved projection 24 of the trigger 14 is proximate and capable of sliding contact with the concave curved projection 22 of the hammer. In FIG. 1 these concave and convex surfaces are in contact, thus preventing the hammer 10 from rotating counter-clockwise in this view. In the ready to fire position, not shown, the concave 22 and convex 24 curved projections will not be in contact as the hammer 10 will be rotated by a trigger spring, not shown, generally clockwise in FIG. 1 with the sear engagement end 20 of the trigger interfacing with the sear 16.

The disconnector 12 in FIG. 1 is shown pivotally carried through a rotatable element or projection 26 formed on the disconnector 12. The disconnector is pivotally carried in a recess 30 of the trigger 14. The disconnector 12 includes an engagement stabilizing projection 32 not found on known disconnectors. This engagement stabilizing projection 32, also referred to as a wall or a limiter, limits the travel of the disconnector interfacing projection 34 of the hammer 10 from moving away from the disconnector engagement location of the trigger assembly 11.

Figure 4:
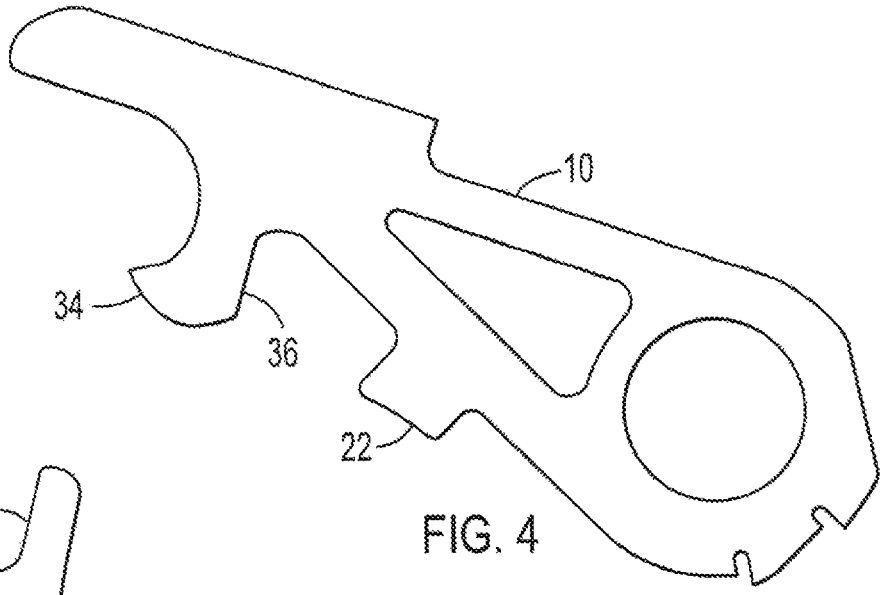
FIG. 4 is a depiction, in elevation view, of the hammer used in the trigger assembly shown in FIG. 1.
Figure 3:
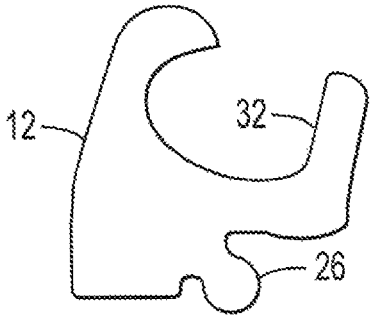
FIG. 3 is a depiction, in elevation view, of the disconnector used in the trigger assembly shown in FIG. 1.
Figure 2:
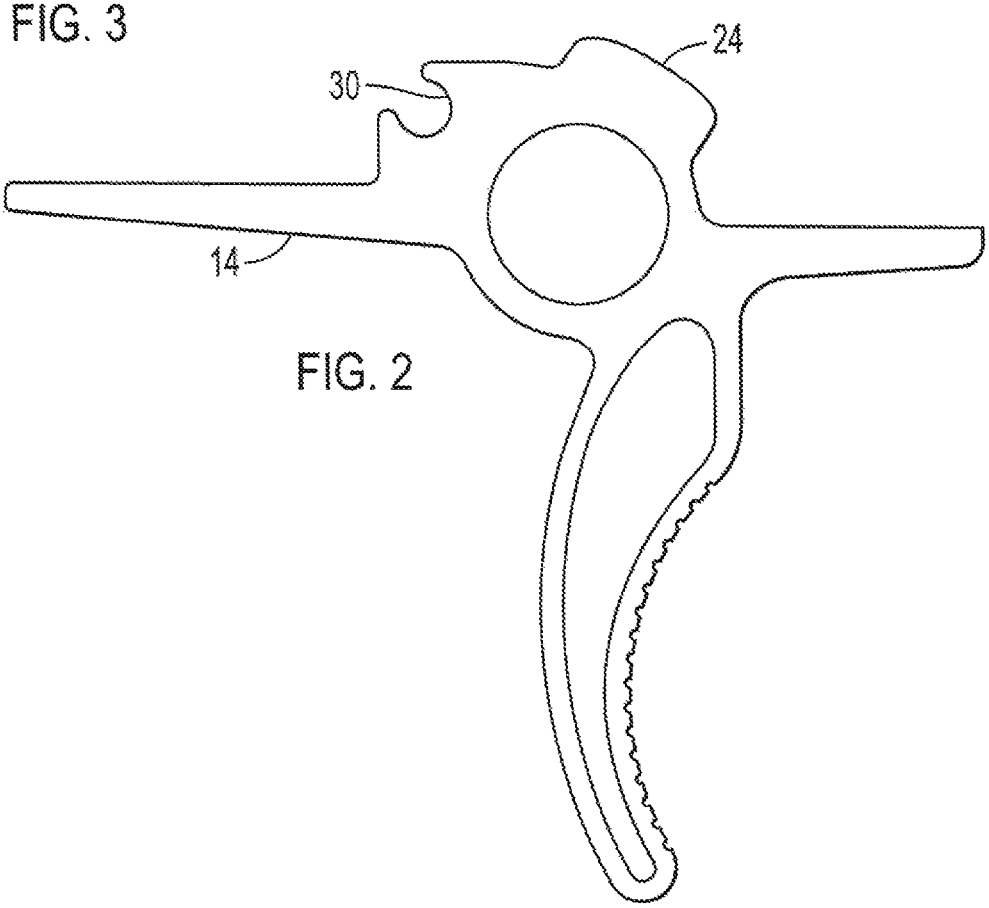
FIG. 2 is a depiction, in elevation view, of the trigger used in the trigger assembly shown in FIG. 1.

FIGS. 2-4 are component parts of the trigger assembly 11 that are modified from what is normally known in the trigger assembly art. These three parts are only three of the components that make up a trigger assembly but these are the parts modified to make this captive disconnector improvement of prior known trigger assemblies.

In summary the invention comprises a trigger assembly having a modified hammer, a modified trigger, and a modified disconnector. The hammer comprises a concave projection extending outwardly from the pivot point of the trigger. The concave projection generally extends from about the 12:00 o'clock position relative to the pivot point of the trigger when the hammer is pivotable mounted in a workable position in the frame of the host trigger assembly housing to about the 2:00 o'clock position relative to the pivot point of the trigger. The trigger itself has a convex projection generally extending from about the 12:00 o'clock position relative to the pivot point of the trigger to about the 2:00 o'clock position relative to the pivot point of the trigger. These "clock" positions can be longer or shorter based on the nuances of trigger design. The modification to the known disconnector is the inclusion of the disconnector interfacing projection 34 shown clearly in FIGS. 1 and 3. Normally a disconnector will have a cavity to accommodate the disconnector interfacing projection of the hammer. In this modified disconnector there is a wall or engagement stabilizing projection 32 providing for the non-latching surface 36 of the hammer to interface with the engagement stabilizing projection 32 of the disconnector.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments defines or constrains the invention.

The invention claimed is:

1. A trigger assembly comprising:

a hammer having a lower surface and a concave curved projection extending relatively downwardly from the lower surface of the hammer;

a trigger having a convex curved projection located proximate the concave curved projection of the hammer, the convex surface on the trigger capable of interfacing with the concave curved projection of the hammer, the convex surface of the hammer having a radius substantially identical to the radius of the trigger's concave curved projection whereby;

the relationship of the trigger and the hammer of the trigger assembly provides a trigger/hammer interface when the convex curved projection of the trigger is proximate the concave curved projection of the hammer;

the trigger assembly further comprising a captive disconnector having a disconnector engagement stabilizing projection formed as a portion of the disconnector, the stabilizing projection of the captive disconnector further comprises the disconnector having a hook, the stabilizing projection located opposite from the hook of the disconnector;

wherein the disconnector comprises an engagement stabilizing projection; and the hammer comprises a disconnector interfacing projection;

the engagement stabilizing projection limits the travel of the disconnector interfacing projection of the hammer from moving away from the disconnector engagement location of the trigger assembly.

* * * * *